US006484461B1

(12) United States Patent
Schofield

(10) Patent No.: US 6,484,461 B1
(45) Date of Patent: Nov. 26, 2002

(54) BUILDING COMPONENT

(76) Inventor: Frederick Andrew Schofield, 3 Crawfordsburn Way, Newtownards, County Down BT23 4RY (GB)

( * ) Notice: Subject to any disclaimer, the term of this patent is extended or adjusted under 35 U.S.C. 154(b) by 0 days.

(21) Appl. No.: 09/194,388

(22) PCT Filed: May 30, 1997

(86) PCT No.: PCT/GB97/01470

§ 371 (c)(1),
(2), (4) Date: Nov. 3, 1999

(87) PCT Pub. No.: WO97/45608

PCT Pub. Date: Dec. 4, 1997

(30) Foreign Application Priority Data

May 31, 1996 (GB) ..... 9611386

(51) Int. Cl.[7] ..... E04D 13/15

(52) U.S. Cl. ..... 52/300; 52/11; 52/94; 52/96; 52/97; 52/262

(58) Field of Search ..... 52/95, 90, 11, 52/58, 94, 97, 300, 302.1, 302.4, 102, 262, 285.1, 608, 533, 536

(56) References Cited

U.S. PATENT DOCUMENTS 945,439 A * 1/1910 Beidler
1,287,204 A * 12/1918 Boyer
1,470,305 A * 10/1923 Wagoner
2,975,561 A * 3/1961 Branham
3,440,780 A * 4/1969 Adam et al.
5,245,803 A * 9/1993 Haag
5,274,975 A * 1/1994 Haag
5,438,810 A * 8/1995 Bullen et al.
5,729,933 A * 3/1998 Strength
5,956,909 A * 9/1999 Chou
6,026,616 A * 2/2000 Gibson
6,223,489 B1 * 5/2001 Fisher

* cited by examiner

*Primary Examiner*—Robert Canfield
(74) *Attorney, Agent, or Firm*—Ronald E. Greigg

(57) ABSTRACT

A building component comprises a cladding unit having an overhang portion and a securing portion. The outer face of the overhang portion serves as a barge/fascia board. The lower face of the overhang portion serves as a soffit. The cladding unit is thin walled and of sideways S-shape with three spaced upright parallel walls. Two walls namely one outer wall and the center wall are connected by a lower plate at their lower edges and form the overhang and two walls namely the center wall and the second outer wall are connected by an upper plate at their upper edges and form the securing portion.

17 Claims, 8 Drawing Sheets

BUILDING COMPONENT

SUMMARY OF THE INVENTION

This invention relates to a Building Component for use in constructing a roof for a building primarily, but not only, a building constructed having a "double skin" outer wall(s) particularly, but not necessarily, having a cavity between said skins, the cavity normally being filled or substantially so with an insulation material.

While this invention is primarily concerned with the provision of gable wall overhangs, barge boards and soffits, it is also applicable to the provision of front/rear wall overhangs, fascia boards and soffits. Heretofore, overhangs have been constructed of timber as have barge boards and soffits which require regular painting maintenance with both barge boards and soffits being susceptible to rot and decay and requiring periodic replacement. Separate barge boards and soffits have also been provided of synthetic plastics material. While these are beneficial in requiring little maintenance, they tend to degrade when exposed to sunlight, due to ultra violet radiation and thermal stresses due to temperature fluctuations. These existing building components are disadvantageous, and an object of the present invention is to obviate or mitigate these disadvantages. Also, a requirement of building regulations currently in force is the capping or closing-off of the top of a cavity. This capping operation is normally achieved by fabrication on site using a board of natural or synthetic material in the same, a preceding or a succeeding operation including the gable wall overhang, the barge board and the soffit.

Accordingly, the present invention is a building component comprising a cladding unit having an overhang portion and a securing portion, the outer face of the overhang portion serving as a barge/fascia board. A lower face of the overhang portion beneficially serves as a soffit.

Preferably, the cladding unit is thin walled and of sideways S-shape with three spaced upright parallel walls, two walls of which one outer wall and the centre wall being connected by a lower plate at their lower edges and two walls, the centre wall and the second outer wall being connected by an upper plate at their upper edges. The one outer wall to serve as the barge/fascia board may be of greater length than the other two walls which may be of equal length or substantially so. The lower plate beneficially serves as the soffit. The centre wall, upper plate and the second wall preferably serve as the securing portion to fit over the wall.

The securing portion also includes a capping tile portion to extend across the cavity. In a first aspect of the invention, the upper plate is of dimension to fit over the double skinned wall of the building whereby to serve as an included capping tile portion. In a second aspect of the invention, the upper plate is of dimension to fit over the outer skin of the wall of the building and the capping tile portion is a second lower plate extending out from the second wall away from the centre wall. A fourth upright wall may be provided at the outer edge of the second lower plate to abut or be contiguous against the inner skin of the wall of the building. At the transition between the one outer wall and the first lower plate. a drip provision is beneficially provided in the form of a channel or an elongate protuberance.

The cladding unit is desirably the same or substantially the same length as a building block and is for use with others of its kind in being laid side-by-side as a course on top of a wall. Alternatively, the cladding unit may be provided in desired multi-block lengths.

Preferably also, the cladding unit is made of any durable material, for example cementitious material and desirably has a mat or fibre reinforcement of synthetic material.

Embodiments of the present invention will now be described, by way of example, with reference to the accompanying drawings, in which:

BRIEF DESCRIPTION OF THE DRAWINGS

FIGS. 6A and 68 are respectively, a perspective view and a side elevational view of a cladding unit according to a second embodiment with an extended overhang portion.

Figure 1:
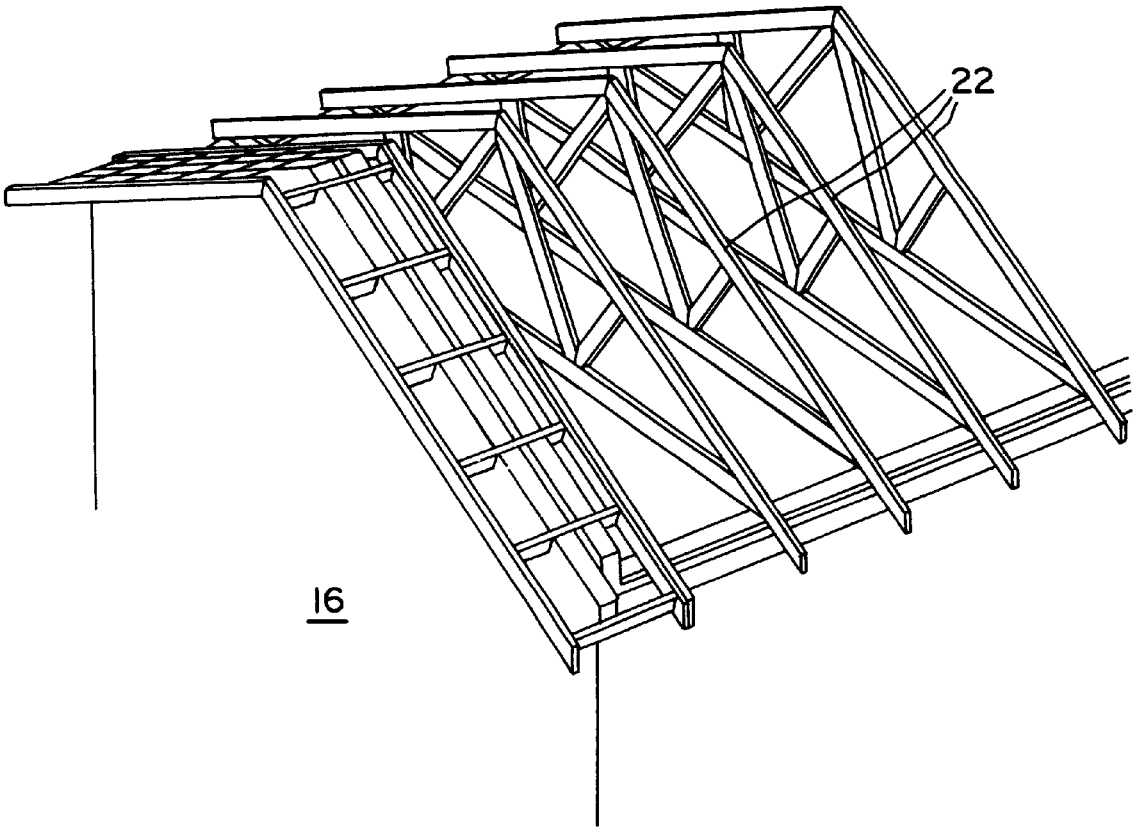
FIG. 1 is a perspective view of a part of a top and one gable of the building having a roof support structure with a gable overhang, a barge board and a soffit constructed conventionally.

Referring to the drawings, a building component comprises a cladding unit 8/8' having a securing portion 10/10' and an overhang portion 12. The securing portion also includes a capping tile portion to extend across the cavity.

The cladding unit 8/8' is thin walled and of sideways S-shape with three spaced upright parallel walls 14A, 10A, 10B, two walls of which one outer 14A and the centre wall 10A being connected by a lower plate 14B at their lower edges, and two walls of which, the centre wall 10A and the second outer wall 10B being connected by an upper plate 11 at their upper edges. The one outer wall 14A to serve as the barge/fascia board is of greater height than the other two walls 10A, 10B which are of equal length or substantially so. The lower plate 148 serves as the soffit. The centre wall 1 OA, upper plate 11 and the second wall 10B serve as the securing portion 10/10' to fit over the wall 16/17 of a building.

Figure 4A:
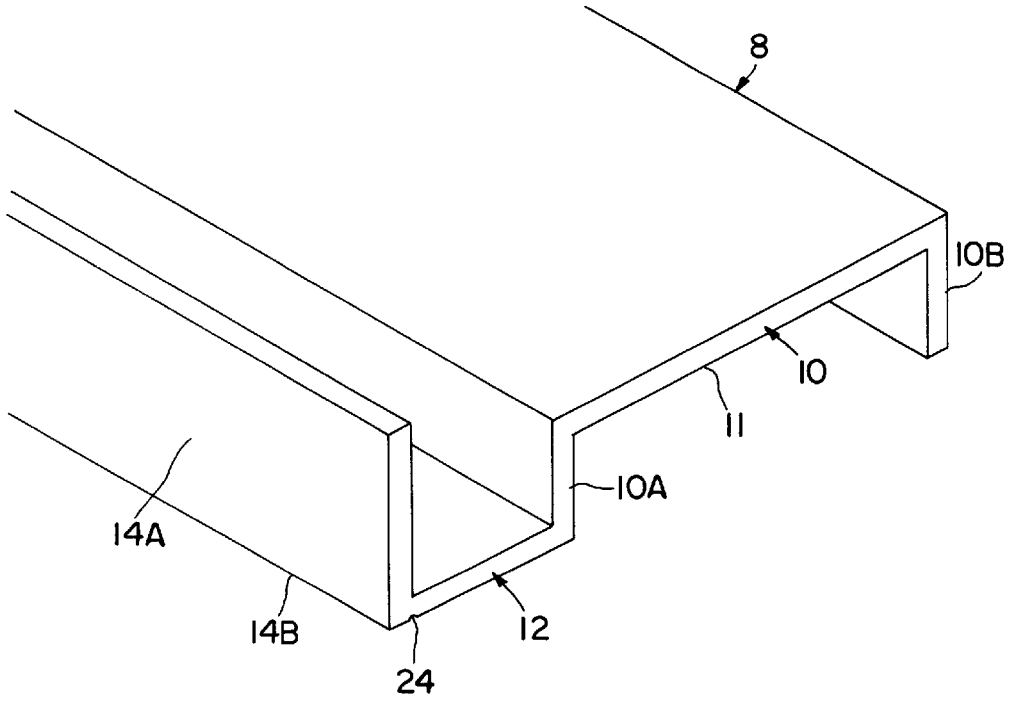
FIGS. 4A and 4B are respectively a perspective view and a side elevational view of a cladding unit according to a first embodiment.
Figure 4B:
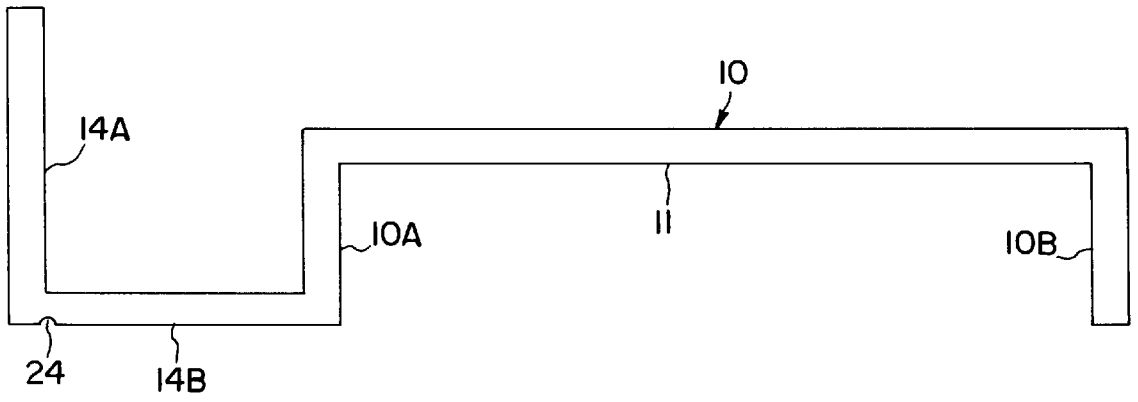
Figure 5A:
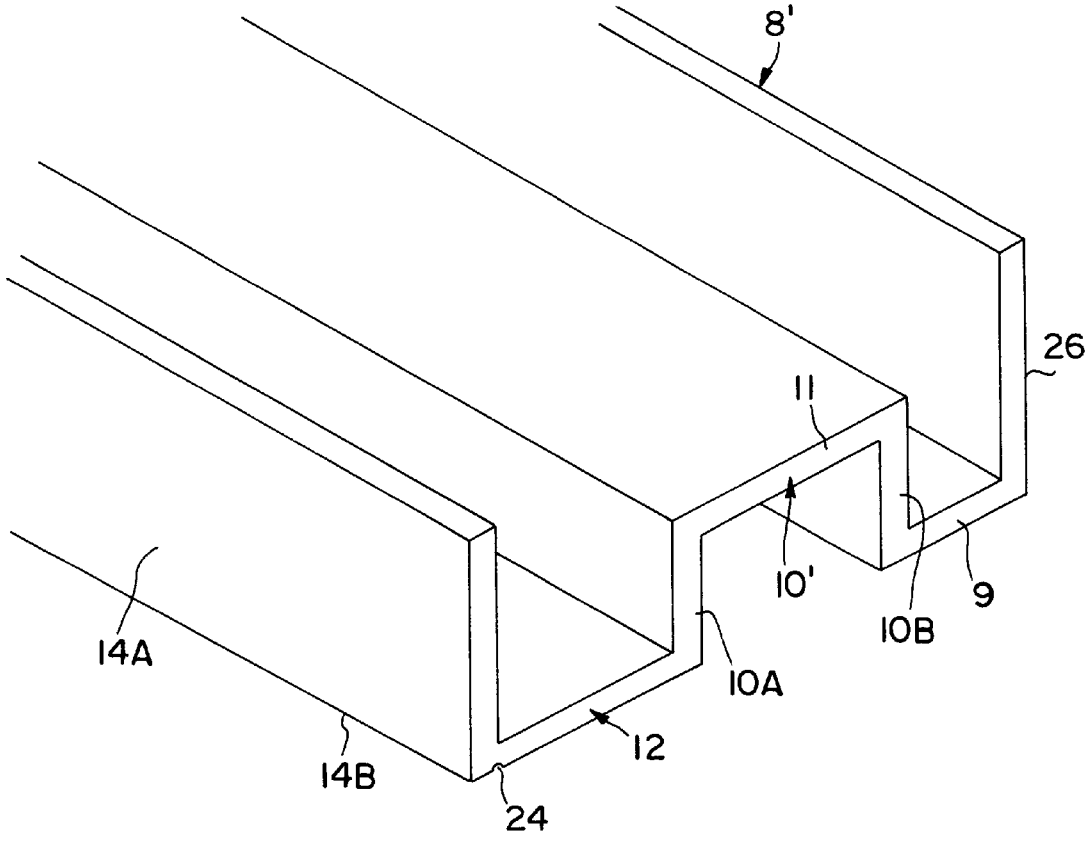
FIGS. 5A and 5B are respectively a perspective view and a side elevational view of a cladding unit according to a second embodiment.
Figure 5B:
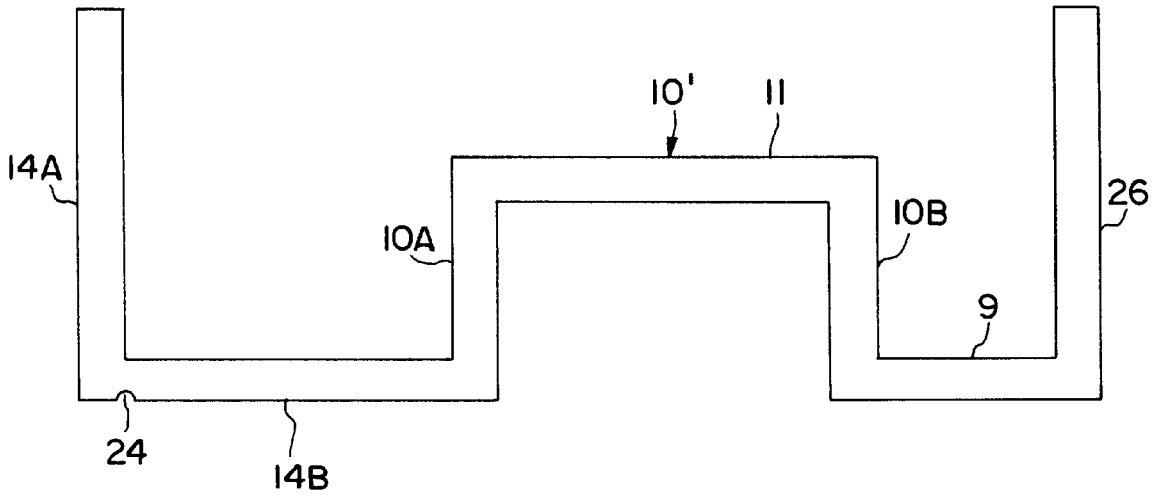
Figure 6A:
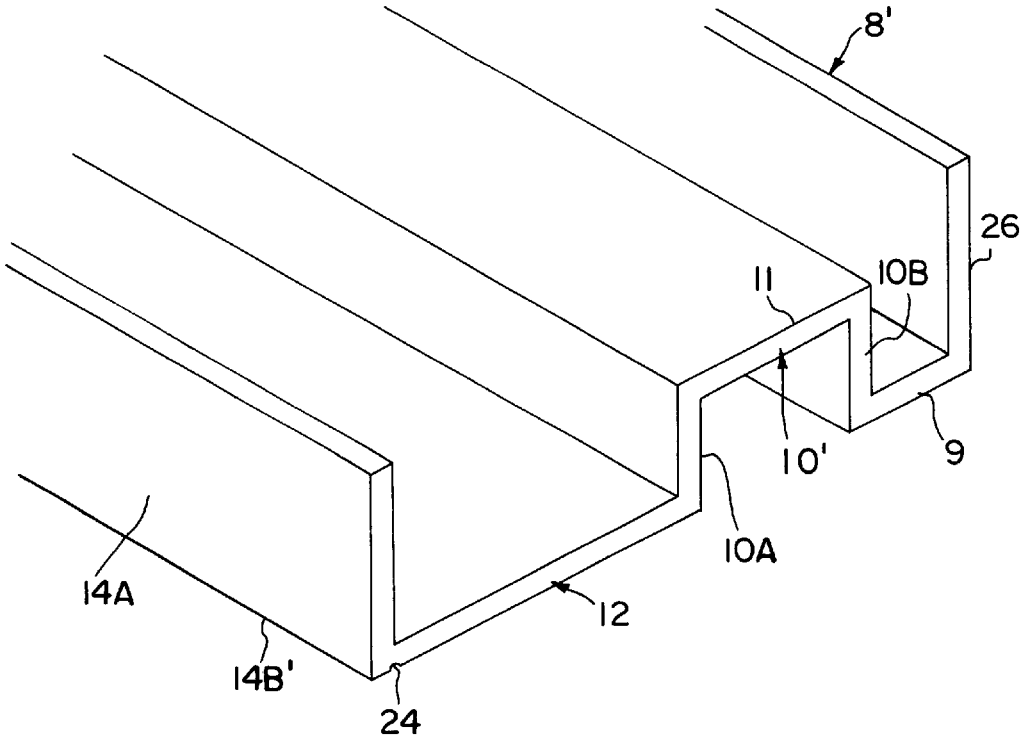
Figure 6B:
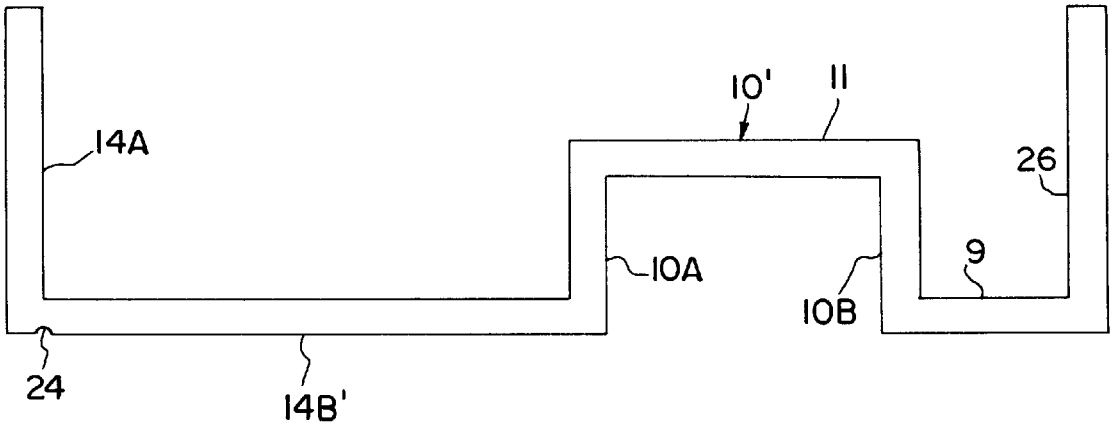
Figure 10:
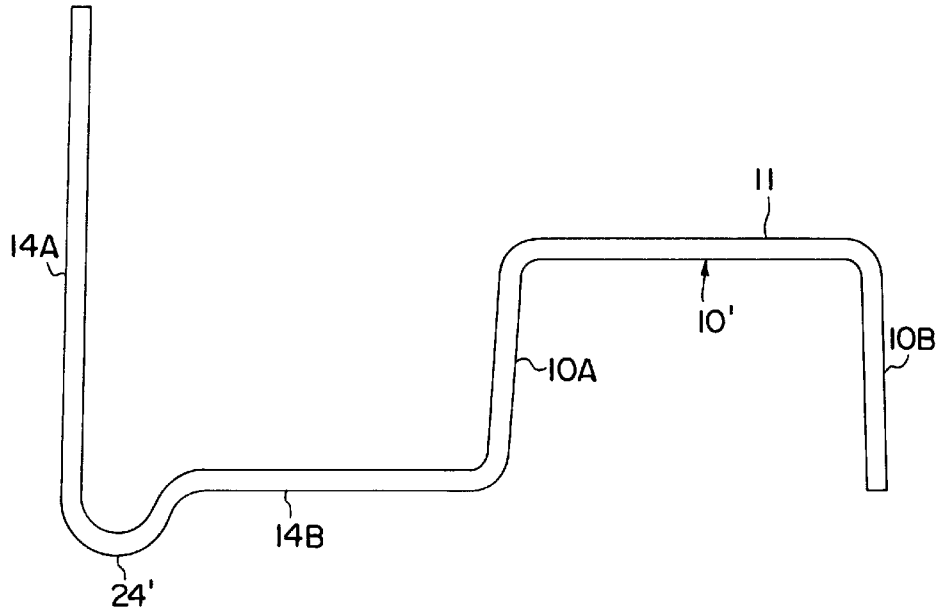
Figure 11:
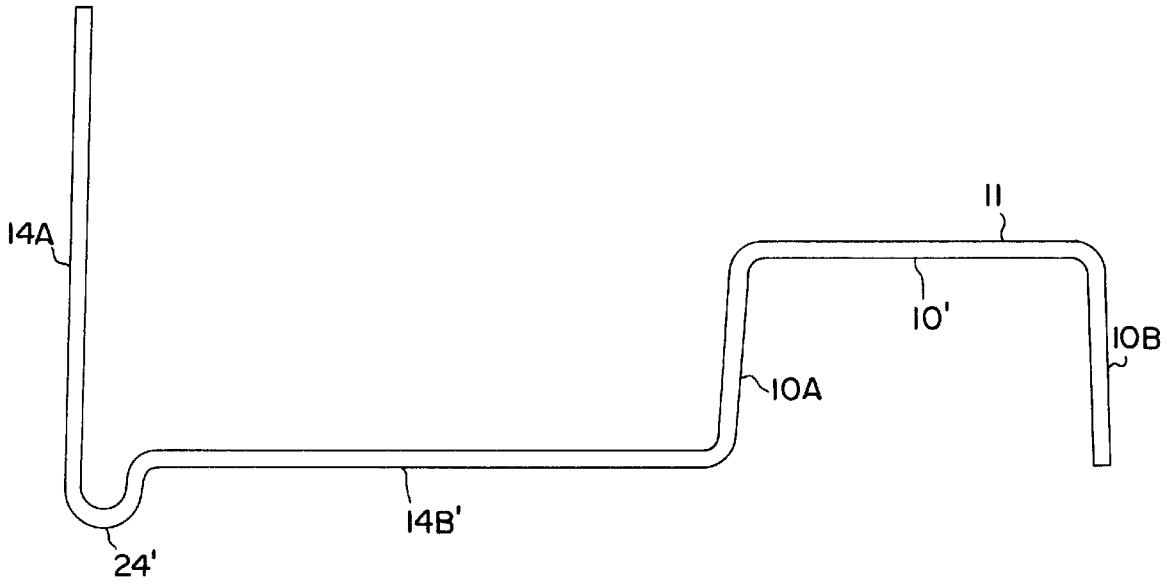

In a first embodiment (as shown in FIGS. 4A,4B) of the invention, the upper plate 11 is of dimension to fit over a double skinned wall of the building whereby to serve as an included capping tile portion to overly and close off the cavity between both skins in the wall. In a second embodiment (as shown in FIGS. 5A,5B) of the invention, the upper plate 11 is of dimension to fit over the outer skin of a wall of the building and the capping tile portion is a second lower plate 9 extending out from the second wall 10B away from the centre wall 10A. A fourth upright wall 26 is provided at the outer edge of the second lower plate 9 to abut or be contiguous against the inner skin of the wall of the building. In both embodiments, at the transition between the one outer wall 14A and the first lower plate 148, a drip provision is provided in the form of a channel 24 (FIGS. 4A to 9) or an elongate protuberance 24' (FIGS. 10 and 11).

Conveniently, the cladding unit 8/8' is the same or substantially the same length as a building block and is for use with others of its kind in being laid side-by-side as a course on top of a wall 16/17 with a securing portion 10/10' thereover and the overhang portion 12 projecting outwardly beyond the wall 16/17.

Figure 2:
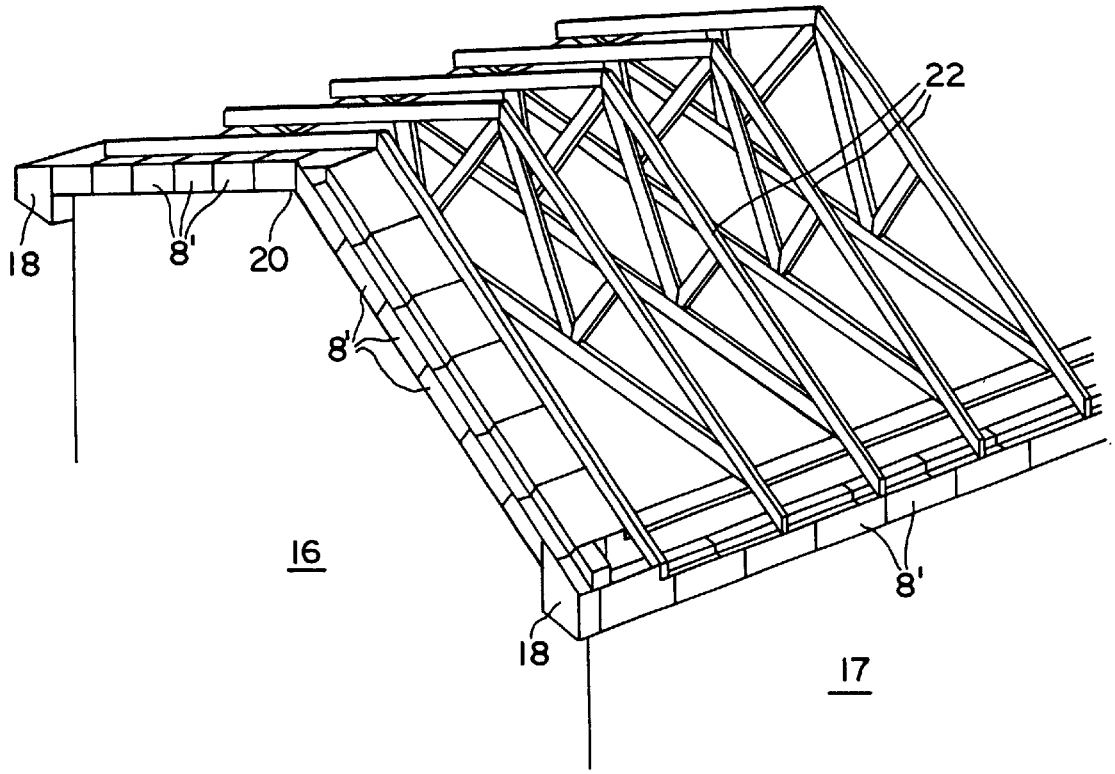
FIG. 2 is a perspective view of a part of a top and one gable of a building having a roof support structure with a course of cladding units according to a first embodiment of the present invention.
Figure 3:
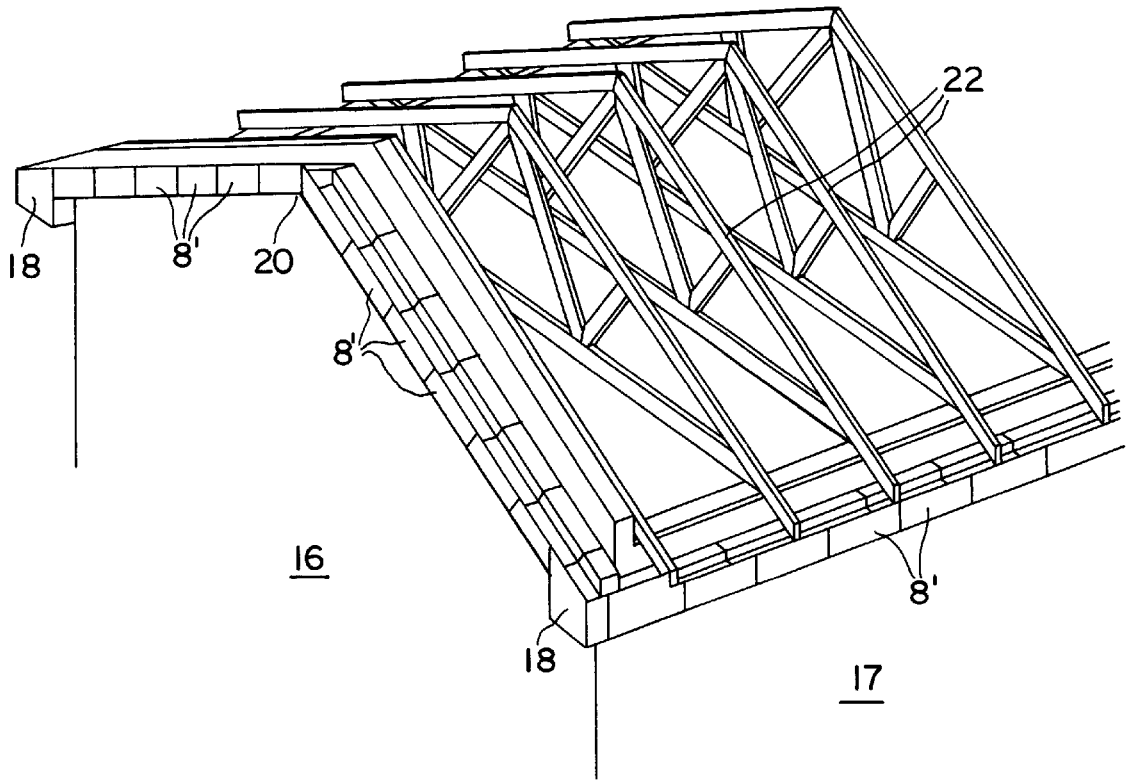
FIG. 3 is a perspective view of a top and one gable of a building having a roof support structure with a course of cladding units according to a second embodiment of the present invention.

The cladding unit 8/8' is made of any durable material, for example cementitious material, and can be coloured to suit a particular colour scheme for the rest of the normally painted or coloured parts of the building, for example window frames or doors. Corner or end units 18 are provided to terminate a course of cladding units 8/8' as shown in FIG. 2 & FIG. 3 laid on top of the gable wall 16 in the same manner as conventional bricks or blocks are laid using mortar, or formed from the same cladding material. An apex 20 is formed by providing mitre sides to the cladding units 8/8' to be abutting at the vertex of the wall. The top surfaces of the cladding unit 8/8' are flush with the top surfaces of a series of rafters 22 which together provide a roof support structure for a tiled or slated roof including battens and felt/underlay.

The outer face of the overhang portion 12 when being moulded may be provided with a wood grain or other ornamental/decorative effect.

A gable and front/rear overhang, when formed in the manner described above, is beneficial over the existing provision of such and requires little or no maintenance.

Although the invention has been described in connection with pitched gable walls, the building component can equally be used with gable walls of hipped or flat-roofed structures, and with front and rear walls of pitched gable, hipped or flat-roofed structures. Also, the invention can be used on walls constructed from two different types of material, for example a timber inner skin and an outer brick or other type of cladding. In this case, the insulation for the cavity may be secured to the inner skin prior to the creation of the cavity by the erection of the outer skin. Further, although the invention has been described for use with cavity walls, it is usable on solid walls formed, for example by constructing the wall from blocks on their 'flat' rather than on 'edge'. The invention should be construed accordingly.

In a first modification of both embodiments, a cladding unit is provided in a desired multi-block length equal to, and to locate between, a formed apex unit and a corner or end unit in each gable wall. Such length units may also be used in multiples along front or rear walls between corner or end units.

In a second modification of both embodiments, the lower plate 14B is of increased width to provide an extended overhang portion as shown in FIGS. 6A, 6B, 8, 11.

In a first modification of the second embodiment, the inner end of the securing portion of the cladding unit is rebated to accommodate a heat insulation batt, namely the securing portion 10/10' has at its inner end a heat insulation batt secured against the outer side of wall 26 or the capping tile portion.

In a further modification of the second embodiment, the fourth wall 26 may be omitted.

Figure 7:
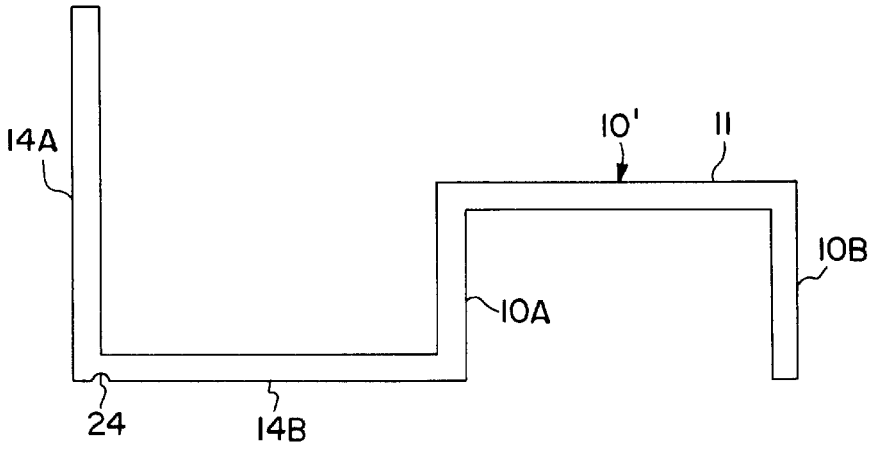
FIGS. 7 to 11 are side elevational views of cladding units according to a simplified embodiment, FIGS. 8 and 11 showing an extended overhang.
Figure 8:
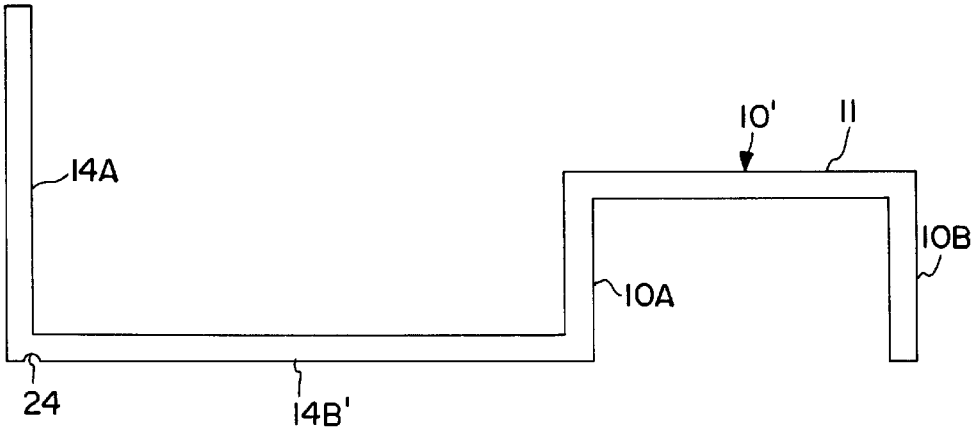
Figure 9:
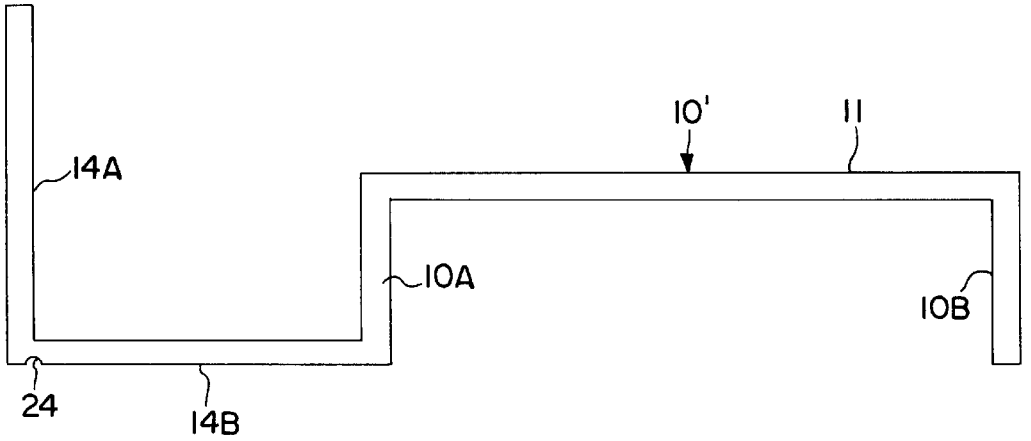

In a simplified embodiment as shown in FIGS. 7 and 8 no capping tile portion is provided.

The foregoing relates to a preferred exemplary embodiment of the invention, it being understood that other variants and embodiments thereof are possible within the spirit and scope of the invention, the latter being defined by the appended claims.

What is claimed is:

1. A building component used with the wall of a building to cap the building wall, said building component comprising a cladding unit having an overhang portion and a securing portion, an outer face of the overhang portion serving as a fascia board and a lower face of the overhang portion serving as a soffit, the cladding unit being thin walled and cross-sectionally of substantially an S-shape with three spaced upright parallel walls, two walls of which, one outer wall and the center wall, being connected by a lower plate at their lower edges and two walls, the center wall and the second outer wall, being connected by an upper plate at their upper edges, the cladding unit being dimensioned with respect to the thickness of the building wall such that the center wall and the second outer wall, along with the upper plate, form the securing portion for the building wall, such that when the securing portion is placed over the top of the building wall the securing portion caps the building wall, with the center wall and the second outer wall just fitting around the outer surfaces of the building wall, and wherein the securing portion also serves as a capping portion by extending across a cavity in the wall.

2. A building component according to claim 1, wherein the building wall is double skinned, and the upper plate is dimensioned to just fit over the doubled-skinned wall.

3. A building component which forms a capping unit which caps a wall of a building, said building component comprising a cladding unit having an overhang portion and a securing portion, an outer face of the overhang portion serving as a fascia board and a lower face of the overhang portion serving as a soffit, the cladding unit being thin walled and cross-sectionally of substantially an S-shape with three spaced upright parallel walls, two walls of which, one outer wall and the center wall, being connected by a lower plate at their lower edges and two walls, the center wall and the second outer wall, being connected by an upper plate at their upper edges, wherein the center wall, the upper plate and the second outer wall serves as the securing portion, and fits over the wall of a building, and wherein the securing portion also serves as a capping portion by extending across a cavity in the wall, and wherein the upper plate is dimensioned to fit over an outer skin of the wall of a building, and the capping portion is a second lower plate extending out from the second outer wall away from the center wall.

4. A building component according to claim 3, wherein a fourth upright wall is provided at an outer edge of the second lower plate to abut against an inner skin of the wall of a building.

5. In combination with a building wall, a building component used as a capping unit to cap the building wall, said building component comprising a cladding unit having an overhang portion and a securing portion, an outer face of the overhang portion serving as a fascia board and a lower face of the overhang portion serving as a soffit, the cladding unit being thin walled and cross-sectionally of substantially an S-shape with three spaced upright parallel walls, two walls of which, one outer wall and the center wall, being connected by a lower plate at their lower edges and two walls, the center wall and the second outer wall, being connected by an upper plate at their upper edges to form the securing portion, the securing portion being dimensioned with respect to the building wall such that when placed over the top of the building wall the securing section forms a cap for the building wall.

6. A building component adapted for use as a capping unit to cap a building wall having a particular thickness, said building component comprising a cladding unit having an overhang portion and a securing portion, an outer face of the overhang portion serving as a fascia board and a lower face of the overhang portion serving as a soffit, the cladding unit being thin walled and cross-sectionally of substantially an S-shape with three spaced upright parallel walls, two walls of which, one outer wall and the center wall, being connected by a lower plate at their lower edges and two walls, the center wall and the second outer wall, being connected by an upper plate at their upper edges, the cladding unit being dimensioned with respect to the thickness of the building wall such that the center wall and the second outer wall, along with the upper plate, form the securing portion for the building wall, such that when the securing portion is placed over the top of the building wall the securing portion caps the building wall, with the center wall and the second outer wall just fitting around the outer surfaces of the building wall, and wherein, at a transition between said one outer wall and the lower plate, a drip provision is provided in the form of an elongate protuberance.

7. A building component according to claim 6, wherein said one outer wall serves as the fascia board, and is of greater length than the other two walls, which other two walls are of substantially equal length.

8. A building component according to claim 6, wherein the lower plate serves as a soffit.

9. A building component according to claim 7, wherein the lower plate serves as a soffit.

10. A building component according to claim 6, wherein the wall of the building is made from blocks, and the cladding unit is substantially the same length as one of said blocks, and said building component is used with others of its kind by being laid side-by-side as a course on top of the wall.

11. A building component according to claim 7, wherein the wall of the building is made from blocks, and the cladding unit is substantially the same length as one of said blocks, and said building component is used with others of its kind by being laid side-by-side as a course on top of the wall.

12. A building component according to claim 8, wherein the wall of the building is made from blocks, and the cladding unit is substantially the same length as one of said blocks, and said building component is used with others of its kind by being laid side-by-side as a course on top of the wall.

13. A building component according to claim 6, wherein the wall of the building is made from blocks, and the cladding unit is provided in multi-block lengths.

14. A building component according to claim 7, wherein the wall of the building is made from blocks, and the cladding unit is provided in multi-block lengths.

15. A building component according to claim 8, wherein the wall of the building is made from blocks, and the cladding unit is provided in multi-block lengths.

16. A building component according to claim 6, wherein the cladding unit is made of a durable material.

17. A building component according to claim 16, wherein said durable material includes a synthetic material with fibers embedded therein.

* * * * *